US007739960B2

(12) United States Patent
Moll et al.

(10) Patent No.: US 7,739,960 B2
(45) Date of Patent: Jun. 22, 2010

(54) RUNNING GEAR

(75) Inventors: Oliver Moll, Solingen (DE); Klaus Nerger, Neukirchen-Vluyn (DE); Udo Gersemsky, Herdecke (DE)

(73) Assignee: Demag Cranes & Components GmbH, Wetter (DE)

( * ) Notice: Subject to any disclaimer, the term of this patent is extended or adjusted under 35 U.S.C. 154(b) by 257 days.

(21) Appl. No.: 11/844,706

(22) Filed: Aug. 24, 2007

(65) Prior Publication Data

US 2008/0047919 A1 Feb. 28, 2008

(30) Foreign Application Priority Data

Aug. 25, 2006 (DE) ..... 10 2006 039 812

(51) Int. Cl.
*B61C 13/00* (2006.01)

(52) U.S. Cl. ..... 105/155; 105/148; 104/89

(58) Field of Classification Search ..... 104/89, 104/93–95; 105/148, 150, 154, 155
See application file for complete search history.

(56) References Cited

U.S. PATENT DOCUMENTS

| | | | | |
|---|---|---|---|---|
| 3,830,165 | A * | 8/1974 | Turner | 104/172.4 |
| 4,569,290 | A * | 2/1986 | Hecht et al. | 105/154 |
| 4,642,844 | A * | 2/1987 | Johnston | 16/98 |
| 4,984,523 | A * | 1/1991 | Dehne et al. | 105/155 |
| 5,419,260 | A * | 5/1995 | Hamilton | 104/89 |
| 5,492,066 | A * | 2/1996 | Nozaki et al. | 104/93 |
| 5,623,879 | A * | 4/1997 | Gersemsky et al. | 105/150 |
| 5,664,502 | A * | 9/1997 | Wilhelm | 105/30 |
| 5,809,896 | A * | 9/1998 | Gersemsky | 104/93 |
| 5,881,650 | A * | 3/1999 | Gersemsky et al. | 105/154 |
| 5,983,803 | A * | 11/1999 | Eberle | 105/150 |
| 6,058,849 | A * | 5/2000 | Ostholt et al. | 104/93 |
| 6,192,803 | B1 * | 2/2001 | Nishino | 104/93 |
| 6,220,176 | B1 * | 4/2001 | Gersemsky | 105/148 |
| 6,499,408 | B1 * | 12/2002 | Kundel, Sr. | 104/94 |
| 6,644,211 | B2 * | 11/2003 | Baier et al. | 104/172.4 |
| 7,503,263 | B2 * | 3/2009 | Birkigt et al. | 104/111 |
| 2005/0098059 | A1 * | 5/2005 | Wallner | 104/89 |
| 2006/0137564 | A1 * | 6/2006 | Wallner | 104/89 |
| 2007/0186800 | A1 * | 8/2007 | Birkigt et al. | 104/91 |
| 2008/0041806 | A1 * | 2/2008 | Birkigt et al. | 212/315 |
| 2008/0047919 | A1 * | 2/2008 | Moll et al. | 212/346 |

FOREIGN PATENT DOCUMENTS

| | | |
|---|---|---|
| DE | 479 800 PS | 7/1929 |
| DE | 1 902 712 U | 10/1964 |
| DE | 84 34 418 U1 | 4/1985 |
| DE | 34 18 800 C1 | 8/1985 |
| DE | 43 21 758 C2 | 4/1997 |
| DE | 198 16 576 A1 | 10/1999 |

* cited by examiner

*Primary Examiner*—S. Joseph Morano
*Assistant Examiner*—Jason C Smith
(74) *Attorney, Agent, or Firm*—Van Dyke, Gardner, Linn & Burkhart, LLP

(57) ABSTRACT

A running gear, for example, a single-rail lower-flange running gear for hoisting equipment, includes several wheels running on a rail, at least two of which are arranged one behind the other in the direction of travel of the running gear and adapted to be driven by an electric motor. The driven wheels are joined to at least two shafts, which are oriented coaxially to the axis of rotation of said at least two driven wheels.

17 Claims, 3 Drawing Sheets

RUNNING GEAR

FIELD OF THE INVENTION

The present invention relates generally to running gears for hoisting equipment.

BACKGROUND OF THE INVENTION

From German utility model DE 84 34 418 U1 there is known a running gear of a chain block. The running gear includes a U-shaped frame and four wheels adapted to travel on the lower flange of an I-shaped rail. The wheels each have a wheel flange, with which the wheels are guided at the outer side of the lower flange. In the lengthwise direction of the rail, the four wheels are divided into a right pair and a left pair, in the manner of a four-wheeled vehicle. Within the pairs, the two left and the two right wheels are arranged at a distance from one another and one behind the other. Furthermore, one of the two pairs is driven by means of an electric motor. For this, the driven pair of wheels each has a revolving gear rim, arranged in the region of the outer circumference of the wheel flanges. The wheel flanges of the two driven wheels are joined together by a gear arranged between the driven wheels. Thus, this gear meshes with the two wheel flanges of the driven wheels and is fastened on a take-off shaft of a transmission, which is secured to the side of the frame in the lengthwise direction of the rail and, thus, in the direction of travel of the running gear. The frame is thus located between transmission and gear. At the drive end, the electric motor is flanged to the transmission. Furthermore, the frame with the wheels passes around the rail in the manner of a U and has a bolt-shaped cross arm, from which the chain block is hung at the center. The width of the frame can be altered by the cross arm, so that the running gear can be adjusted to the width of different I-shaped rails.

Moreover, from German patent DE 34 18 800 C1 there is known a similar running gear which can travel on the lower flange of an I-shaped rail, especially a suspended rail. This running gear differs essentially from the one previously described in that it has only two wheels with wheel flanges, arranged opposite each other, rather than the four wheels. One of the two wheels is driven by an electric motor with a transmission, which is connected directly to the axle of the driven wheel by its take-off shaft.

From German utility model DE 1 902 712 there is already known a single-rail lower-flange running gear for underhung cranes, including a total of four running wheels arranged one behind the other and opposite each other in the direction of travel. The running wheels are mounted on a right and left side shield, at the inner sides of the side shields. The drive for the running wheels comes from a drive shaft positioned through the side shields at their back side, being connected to an electric motor via the gears of a transmission. The gears of the transmission are enclosed by a housing and thus protected against dirt and grime.

SUMMARY OF THE INVENTION

Based on the problems encountered with the prior art, the present invention provides a running gear, such as a running gear for hoisting equipment, which is low in noise and low in wear, even in dirty surroundings.

According to an embodiment of the present invention, a running gear, such as a running gear for hoisting machines, includes several wheels running along a rail, including at least two wheels arranged one behind the other in the direction of travel of the running gear and adapted to be driven by an electric motor. The at least two driven wheels are joined to shafts that are oriented coaxially to the axis of rotation of the driven wheels. The running gear also includes a right side shield and a left side shield, each having projecting hubs on the inner side, on which the wheels are mounted.

Optionally, one of the running gears is mounted on each shaft and is adapted to mesh with an intermediate gear.

A separation of the wheels from the gears may be achieved in that the shafts are mounted on one side shield of the running gear and the gears and the wheels are arranged at opposite sides of the side shield. This also facilitates a lubrication of the gears, without the lubricant having a negative influence on the transfer of the driving forces of the wheels to the rail.

Optionally, one of the shafts extends beyond the gear and is connected to the electric motor via a transmission, such that the intermediate gear is responsible for the transfer of force to the second shaft.

Alternatively, the intermediate gear may be mounted on an intermediate shaft, which is connected to the electric motor. A transmission may be provided in the form of a transmission gear, mounted on the intermediate shaft, which meshes with a driving gear connected to the electric motor.

Optionally, the running gear may include a housing and a frame. Because of the above described separation of the wheels from the gears, at least the gears or the intermediate gear are enclosed by a part of the housing, which is fastened to the side shield of the frame. The housing or housing part can minimize the running noises of the gears, and more easily enable the gears to be lubricated with oil or grease.

In one embodiment, the electric motor is mounted on the housing. Another embodiment calls for the electric motor driving the shafts via a transmission.

The shafts and the driven wheels may be configured as a single or unitary piece.

In another embodiment, the running gear comprises a U-shaped frame with two driven wheels and two non-driven wheels. The U-shaped frame has a right side shield and an opposite left side shield, which are joined together by a cross arm to make the U-shaped frame and mounted on the respective inner sides of the side shields. The driven and non-driven wheels roll along the lower flange of the rail.

Optionally, the hubs for the driven wheels are hollow and the shafts are positioned through the hubs.

Further, the running gear may be led by guide rollers running along the rail, such that the wheels are adapted to be designed without wheel flanges and the wheel spacing can be shorter.

Thus, the embodiments described above provide a simple bearing of the wheels against the side shields. Because the shafts directly drive the wheels, the wheels can be configured without a revolving gear rim. Furthermore, for wheels with gear rims, the gear rim lies in the rolling contact region of the wheels, which leads to great wear and louder running noise, especially at high speed, due to dirt and grime. Moreover, the diameter of the wheels is smaller than wheels with gear rims, so that the wheel spacing inside the running gear can be chosen to be shorter and, thus, the running gear can negotiate curves more easily. Optionally, a double wheel drive may be implemented.

These and other objects, advantages, purposes and features of the present invention will become apparent upon review of the following specification in conjunction with the drawings.

DESCRIPTION OF THE PREFERRED EMBODIMENTS

Figure 1:
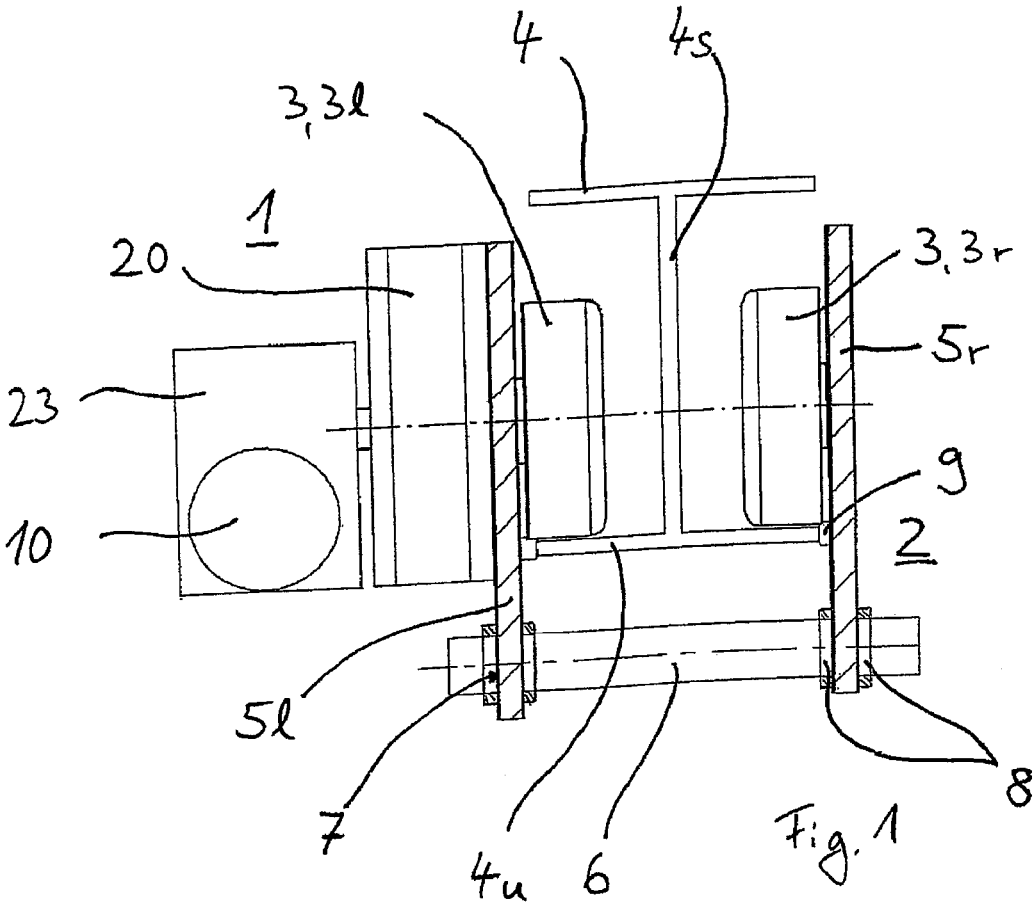
FIG. 1 is a sectional view of a running gear on an I-shaped rail in accordance with the present invention.

Referring now to the drawings and the embodiments illustrated therein, FIG. 1 shows a sectional view of a running gear 1 for a chain block (not shown) or the head piece of a crane. In the illustrated embodiment, running gear 1 includes a frame 2 and four wheels 3, of which one right wheel 3*r* and one left wheel 3*l* can be seen.

Frame 2 is generally U-shaped and encloses from underneath an I-beam rail 4 in the region of its lower flange 4*u* and adjoining web 4*s*. Moreover, frame 2 includes a left side shield 5*l* and a right side shield 5*r*, on which the wheels 3*r* and 3*l* are mounted, and which are joined together by a cross arm 6. Side shields 5*l* and 5*r* have a borehole 7 at bottom center, through which the boltlike cross arm 6 is passed or positioned. Cross arm 6 thus connects the two side shields 5*l* and 5*r* to the frame 2. In the region of the borehole 7, cross arm 6 is secured in the lengthwise direction by rings 8, which abut against the respective sides of the side shields 5*l* and 5*r*. Thus, side shields 5*l* and 5*r* are adapted to be adjusted to the width of the lower flange 4*u* of the rail 4 by the cross arm 6 with the rings 8.

The wheels 3 run along the top side of the lower flange 4*u* of the I-beam rail 4. Furthermore, the wheels have no wheel flanges, since the frame 2 is led by guide rollers 9 at the lateral lengthwise sides of the lower flange 4*u*. Guide rollers 9 are mounted on the side shields 5*l* and 5*r* and are adapted to turn about vertical axes. The vertical axes are thus vertically oriented when the rail 4 runs horizontally.

It can also be seen from FIG. 1 that only the left wheels 3*l* are driven by an electric motor 10, flanged onto the left side shield 5*l* via a transmission 23.

Figure 2:
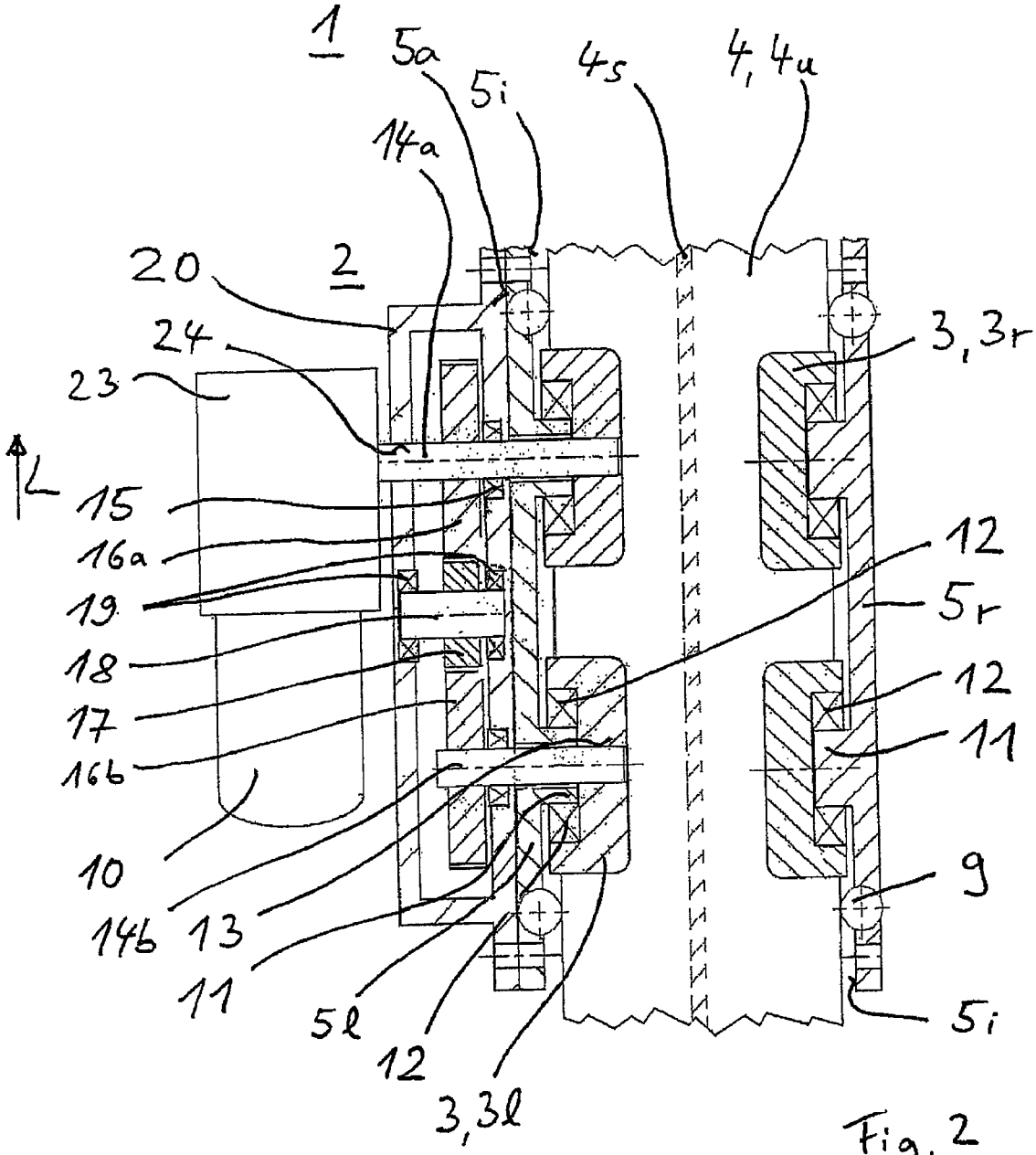
FIG. 2 is a sectional view from above the running gear per FIG. 1, according to a first embodiment.

FIG. 2 shows a sectional view from above of the running gear 1 per FIG. 1 in a first embodiment. The left wheels 3*l* and the right wheels 3*r* are secured one behind the other in the lengthwise direction L of the rail 4, and with a spacing to the respective side shield 5*l* and 5*r*. Left wheels 3*l* and right wheels 3*r* are adapted to turn. Left side shield 5*l* and right side shield 5*r* each include two hubs 11, which extend from the inner side 5*l* facing rail 4 to rail 4, or the opposite right side shield 5*r*. A bearing 12, such as a ball bearing, is provided on the outer circumference of the hubs 11. Bearing 12 carries one of the wheels 3. The hubs 11 on the right side shield 5*r* are fashioned as solid hubs, while the hubs 11 at the left side shield 5*l* are hollow hubs.

In order to drive the left wheels 3*l* of the left side shield 5*l*, central boreholes 13 are provided in the left wheels 3*l*, into which shafts 14*a* and 14*b* are inserted. The shafts 14*a* and 14*b* are adapted to be held in boreholes 13 by positive fit with either multi-tooth connections or press-fit connections. In order to use left and right wheels 3*l* and 3*r* of identical construction, the boreholes 13 can also be provided in the right wheels 3*r*, but have no function there.

The shafts 14*a* and 14*b* are mounted by another bearing 15 in a housing or housing part 20. A surface of housing part 20 lies against the left side shield 5*l* and is connected or joined thereto, such as by a screw or the like. Gears 16*a* and 16*b* are arranged on the shafts 14*a* and 14*b* next to the bearing 15, such as by customary or standard shaft and hub connections. The outer diameter of gears 16*a* and 16*b* may be identical. In order to join together gears 16*a* and 16*b*, which may be spur gears, for drive purposes, an intermediate gear 17 is arranged between the gears 16*a* and 16*b*, and meshes with gears 16*a* and 16*b*. The intermediate gear 17 is mounted on an intermediate shaft 18, which is arranged parallel and in line with the shafts 14*a* and 14*b*. Furthermore, intermediate shaft 18 is mounted at both ends in a bearing 19, which may be a ball bearing. The bearings 19 are mounted in the walls of housing part 20. Thus, housing part 20 is adapted to accommodate gears 16*a* and 16*b*, shafts 14*a* and 14*b*, intermediate gear 17 and intermediate shaft 18. The transmission formed from the gears 16*a* and 16*b*, as well as the intermediate gear 17, is thus enclosed and is adapted to be provided with an oil or grease filling.

In the illustrated embodiment, housing part 20 is configured as enclosed and is thus adapted to be built onto the left side shield 5*l* as a modular component. Housing part 20 may also be configured as a cover, and the left side shield 5*l* as a cup. The reverse could also be done, i.e., housing part 20 may be configured as a cup, while left side shield 5*l* may be configured as a cover.

Furthermore, the first shaft 14*a* extends or protrudes from the left wheel 3*l* by gear 16*a* and protrudes or sticks out from housing part 20. Housing part 20 has a corresponding borehole 24. The protruding end of shaft 14*a* is joined by transmission 23 to the electric motor 10, which is fastened to the outer side of the housing part. In this configuration, the first shaft 14*a* is the driven shaft of the transmission 23.

Moreover, FIG. 2 shows guide rollers 9, which are mounted on the left side shield 5*l* and the right side shield 5*r* and arranged both in front of and behind the left wheels 3*l* and right wheels 3*r* in the lengthwise direction L of the rail 4.

Figure 3:
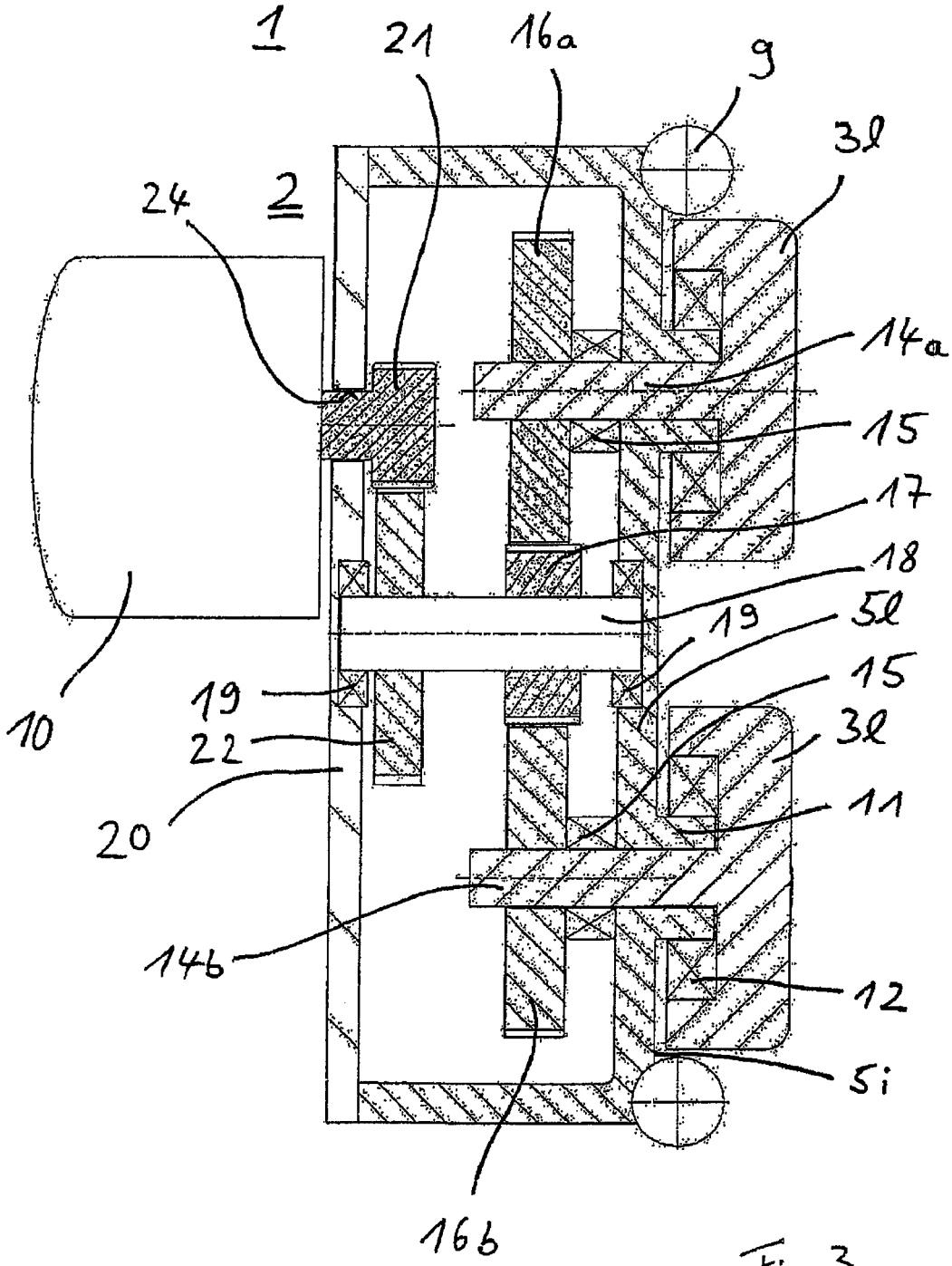
FIG. 3 is a sectional view of the driven part of the running gear per FIG. 1, according to a second embodiment.

FIG. 3 shows a sectional view of the left side shield 5*l* per FIG. 1 in a second embodiment. In the second embodiment, electric motor 10 is not connected directly to the first shaft 14*a*, but instead has a drive gear 21 at the power take-off side. Drive gear 21 meshes with a transmission gear 22 fastened onto the intermediate shaft 18. The first shaft 14*a* has the same length as the second shaft 14*b*. Thus, no transmission 23 is required. The shafts 14*a* and 14*b* are mounted by bearings 15 in the left side shield 5*l*, which has round recesses on its inner side, by which bearings 15 are at least partially enclosed.

As shown in FIG. 3, housing part 20 is lid-shaped and left side shield 5*l* is cup-shaped. The reverse could also be the case, i.e., housing part 20 may be cup-shaped, while left side shield 5*l* may be lid-shaped. Housing part 20 may also be enclosed—as shown in FIG. 2—and is thus adapted to be built onto the left side shield 5*l* as a modular component.

Further, shafts 14*a* and 14*b* and the left wheels 3*l* may be configured as a one-piece or unitary item. The second embodiment shown in FIG. 3 may otherwise be substantially similar to the first embodiment, such that reference is made to the above description of the first embodiment.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A single-rail lower-flange running gear for hoisting machines, said running gear comprising:

a plurality of wheels running along a rail;

a right side shield and a left side shield, wherein said plurality of wheels is mounted on said right side shield and said left side shield, wherein at least two of said plurality of wheels are driven wheels arranged one behind the other in the direction of travel of the running gear and are adapted to be jointly driven by an electric motor;

at least two shafts joined to said driven wheels, said at least two shafts being oriented coaxially to the axis of rotation of said driven wheels and being drivable by said electric motor, wherein at least one of said right side shield and said left side shield includes hollow projecting hubs on an inner side, wherein each of said at least two driven wheels is supported on an outer circumference of a respective one of said hollow projecting hubs, and wherein said at least two shafts are positioned through said hollow projecting hubs and through said at least one of said right side shield and said left side shield;

wherein the other of said right side shield and said left side shield includes at least one solid projecting hub on an inner side thereof, opposite said hollow projecting hubs, wherein said at least one solid projecting hub supports a respective one of said plurality of wheels at said other of said right side shield and said left side shield;

at least two gears, each of said at least two gears mounted on a respective one of said at least two shafts, wherein said at least two gears are arranged at an opposite side of said at least one of said right side shield and said left side shield from said at least two driven wheels; and an intermediate gear adapted to mesh with each of said at least two gears mounted on said at least two shafts.

2. The running gear of claim 1, wherein said at least two shafts are mounted on one of said right side shield and said left side shield of the running gear.

3. The running gear of claim 2, wherein one of said at least two shafts extends beyond said gear mounted on said shaft and is connected to the electric motor via a transmission.

4. The running gear of claim 2, wherein said intermediate gear is mounted on an intermediate shaft connected to the electric motor.

5. The running gear of claim 4, including a transmission gear mounted on said intermediate shaft and a driving gear connected to the electric motor, said transmission gear adapted to mesh with said driving gear.

6. The running gear of claim 5, including a housing and a frame, wherein at least said gears mounted on said at least two shafts and said intermediate gear are enclosed by a part of said housing, said housing fastened to said side shield of said frame.

7. The running gear of claim 6, wherein the electric motor is mounted on said housing part.

8. The running gear of claim 7, wherein the electric motor drives said at least two shafts via a transmission.

9. The running gear of claim 8, wherein said at least two shafts and said driven wheels are configured as a single piece.

10. The running gear of claim 2, including a housing and a frame, wherein at least said gears mounted on said at least two shafts and said intermediate gear are enclosed by a part of said housing, said housing fastened to said side shield of said frame.

11. The running gear of claim 1, wherein said rail is I-shaped, wherein said right side shield and said left side shield are joined together by a cross arm to form a U-shaped frame enclosing said I-shaped rail.

12. The running gear of claim 11, wherein said plurality of wheels are mounted on an inner side of said right side shield and said left side shield, wherein said plurality of wheels roll along a lower flange of said I-shaped rail.

13. The running gear of claim 1, including guide rollers running along a side of said rail for guiding the running gear.

14. The running gear of claim 1, said running gear further comprising:

a cross arm joining said right side shield and said left side shield to form a U-shaped frame; and an I-shaped rail enclosed by said U-shaped frame, wherein said plurality of wheels rolls along a lower flange of said I-shaped rail.

15. The running gear of claim 14, including guide rollers running along a side of said I-shaped rail for guiding the running gear.

16. The running gear of claim 1, further comprising a bearing disposed on the outer circumference of each of said hollow projecting hubs, wherein each of said bearings is adapted to support one of said driven wheels.

17. A single-rail lower-flange running gear for hoisting machines, said running gear comprising:

a plurality of wheels running along a rail;

a right side shield and a left side shield, wherein said plurality of wheels is mounted on said right side shield and said left side shield, wherein at least two of said plurality of wheels are driven wheels arranged one behind the other in the direction of travel of the running gear and are adapted to be jointly driven by an electric motor;

at least two shafts joined to said driven wheels, said at least two shafts being oriented coaxially to the axis of rotation of said driven wheels and being drivable by said electric motor;

wherein each of said right side shield and said left side shield includes projecting hubs on an inner side thereof, and wherein said projecting hubs of at least one of said right side shield and said left side shield comprise hollow projecting hubs, wherein each of said driven wheels is supported on an outer circumference of a respective one of said projecting hubs, and wherein said at least two shafts are positioned through said hollow projecting hubs and through said at least one of said right side shield and said left side shield;

wherein the other of said right side shield and said left side shield includes at least one solid projecting hub on an inner side thereof, and wherein at least one other of said plurality of wheels is supported on an outer circumference of said at least one solid projecting hub; and a bearing disposed on the outer circumference of each of said hollow projecting hubs and each of said solid projecting hubs, wherein each of said bearings is adapted to support one of said plurality of wheels.

* * * * *